United States Patent [19]

Montgomery

[11] 4,172,533

[45] Oct. 30, 1979

[54] CHILD-RESISTANT LOCKING MEANS FOR A CONTAINER

[75] Inventor: Gary V. Montgomery, Evansville, Ind.

[73] Assignee: Sunbeam Plastics Corporation, Evansville, Ind.

[21] Appl. No.: 966,946

[22] Filed: Dec. 6, 1978

[51] Int. Cl.[2] ..... B65D 55/02; B65D 85/56; A61J 1/00

[52] U.S. Cl. ..... 215/216; 215/221

[58] Field of Search ..... 215/216, 221, 330; 222/153

[56] References Cited

U.S. PATENT DOCUMENTS

| | | | |
|---|---|---|---|
| 3,900,123 | 8/1975 | Darlington | 215/216 |
| 3,993,209 | 11/1976 | Julian | 215/216 |

*Primary Examiner*—George T. Hall

*Attorney, Agent, or Firm*—Henry K. Leonard

[57] ABSTRACT

Child-resistant locking means for a container and a cap therefor. The container has a tubular neck and the cap has a circular top and an annular skirt. The container neck and cap have interengageable threads for retaining the cap on the closure. The child-resistant locking means consist of an outwardly extending stop on the container neck and a cap lug engageable therewith to normally prevent retrograde rotation of the cap. The cap lug is located on a curved, resilient, web-like member which extends around the base of the cap and which has outwardly extending struts to space it from the cap. The cap lug is located about 45° from one of the struts. In the preferred embodiment the resilient member is a complete ring, either circular or oval or a similar shape. Squeezing the resilient member inwardly along a diameter spaced about 45° from the cap lug bulges the member outwardly at the lug so that the lug clears the container stop when the cap is rotated for removal.

10 Claims, 9 Drawing Figures

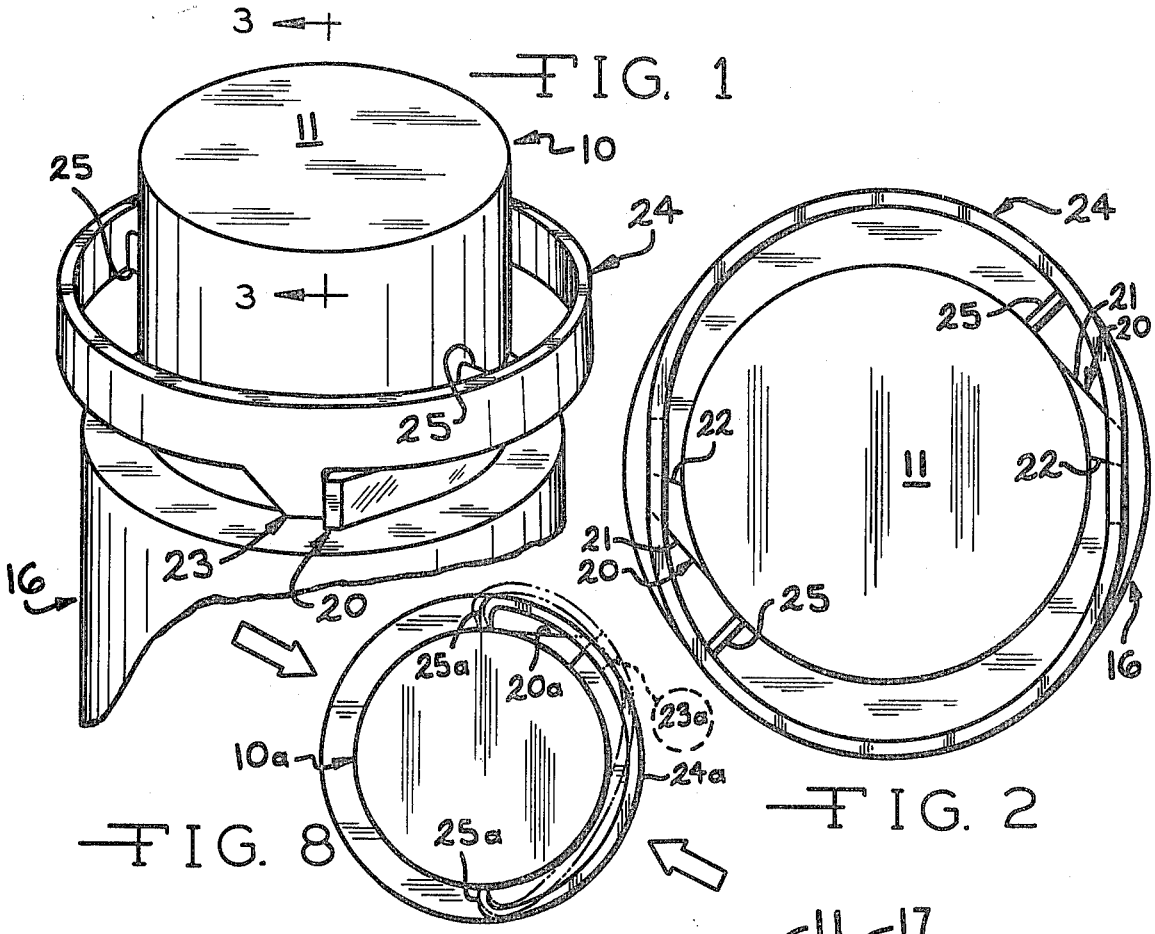
FIG. 1
FIG. 2
FIG. 8
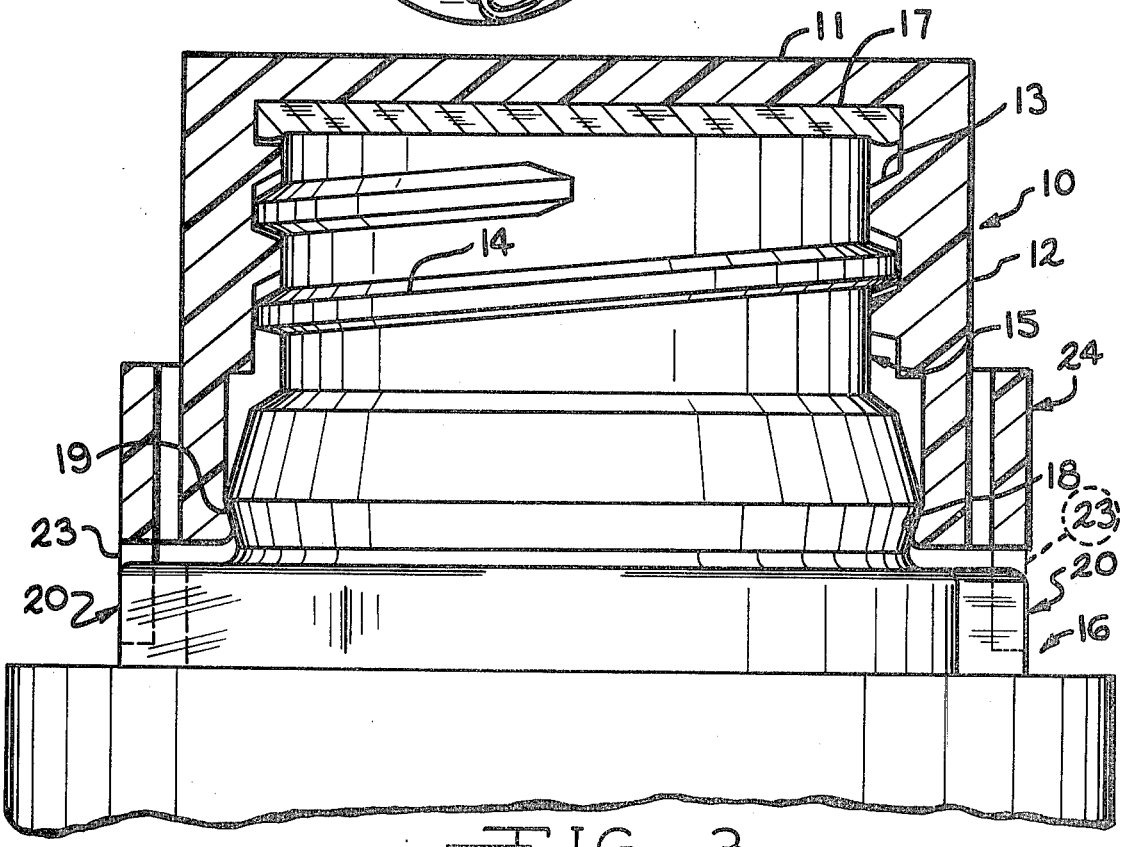
FIG. 3

FIG. 4
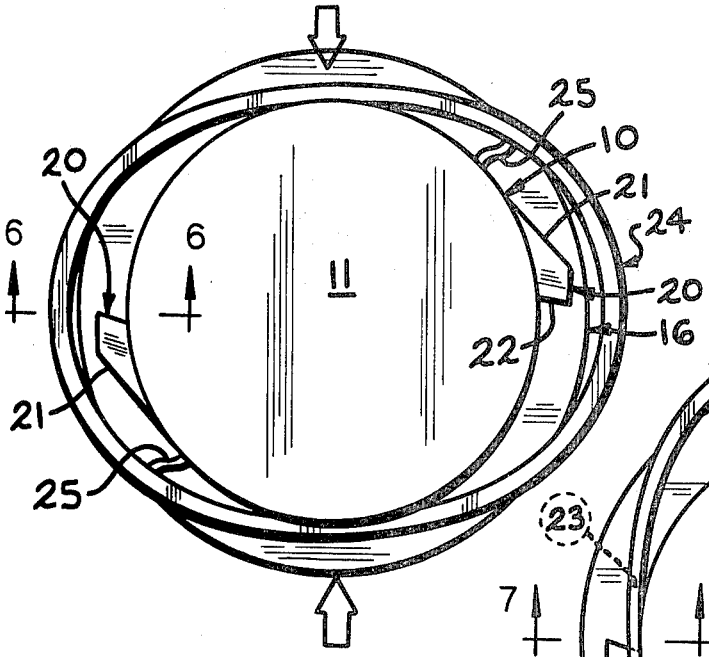
FIG. 5
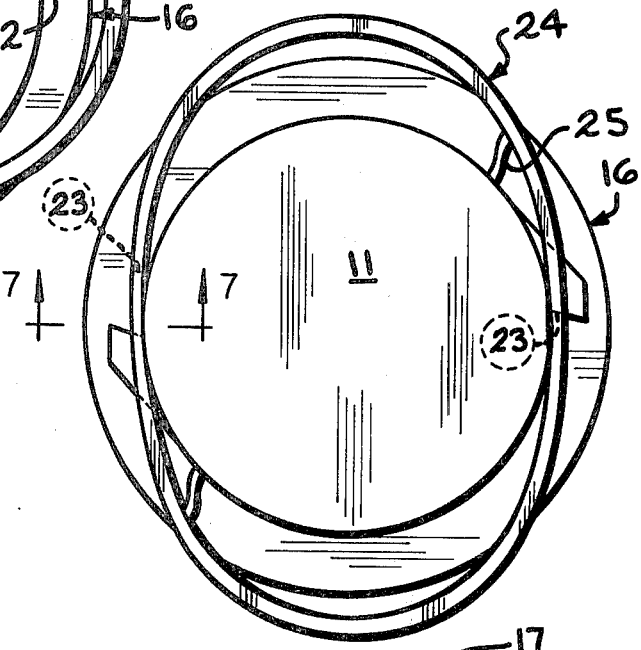
FIG. 6
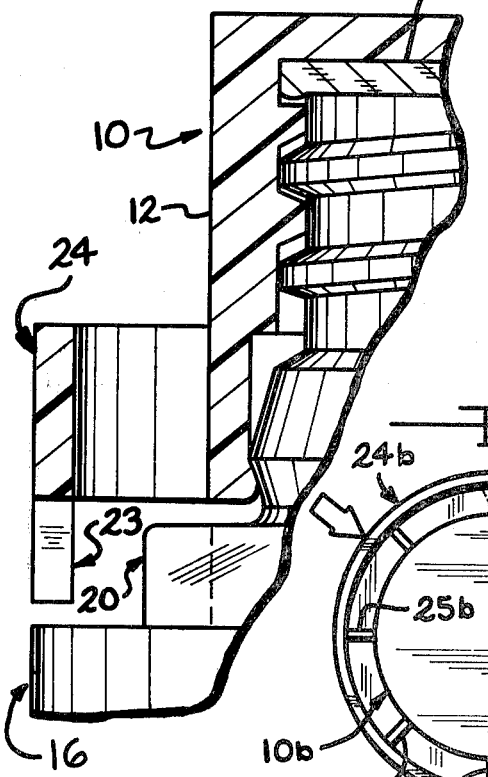
FIG. 9
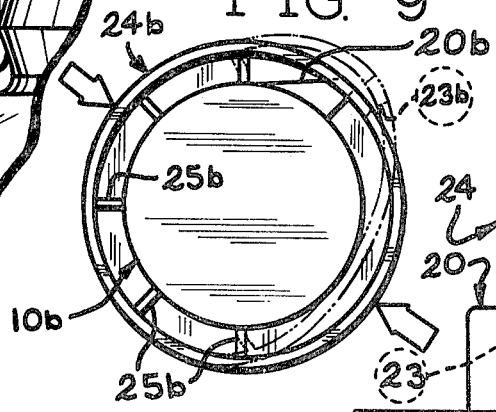
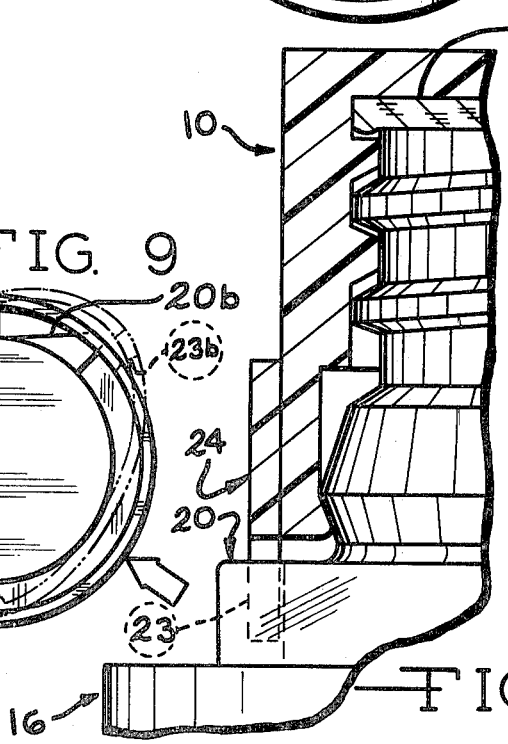
FIG. 7

CHILD-RESISTANT LOCKING MEANS FOR A CONTAINER

BACKGROUND OF THE INVENTION

Of the many types of child-resistant closures for containers in which dangerous and harmful substances are packaged, those which have been most successful seem to have two basic concepts underlining their design. First, from the standpoint of the original manufacturer and utilization by people who initially fill the containers, the caps or closures for the containers should be so designed as to enable their emplacement on the containers by the use of standard capping machines. Second, although a number of two-piece child-resistant caps have been designed and commercialized, if the cap can be made in merely one unitary piece the cost of manufacturing molds is reduced and assembly of the two parts is eliminated.

From the standpoint of effective child-resistance, regardless of whether the cap is one piece or two piece, it has been found that requiring two motions of different types usually provides the most effective resistance to opening by small children. Preferably, however, one of the two motions should not merely be either pulling or pushing on the cap because the small child often does one or the other of these actions when he attempts to remove the cap.

The closure shown in Julian U.S. Pat. No. 3,993,209 is an inverted cup-shaped cap having threads on its single skirt which mate with threads on the container neck and having a locking ring depending from the cap skirt which is connected to the cap skirt by integral flexible webs. The locking ring is resilient and carrys at least one locking lug which cooperates with a stop on the container so when the cap is screwed down onto the container tightly the lug on the cap ring passes the container stop and the cap cannot be removed from the container without squeezing the depending ring to flex that portion of the ring carrying the lug outwardly in order that it can pass the container stop when the cap is unscrewed. This combination of squeezing at a particular place and rotating renders the cap quite child-resistant.

It is the principal object of the instant invention to provide child-resistant locking means for a container and cap which requires both a squeezing and rotating action in order to remove the cap from the container.

It is yet another object of the instant invention to provide child-resistant means for a closure so designed that when it is attempted to remove the cap from the container by merely rotating the cap, the child-resistant means are rendered yet more effective.

And a still further object of the instant invention is to provide a unitary child-resistant cap for use on a closed container having a cooperating neck finish in which the cap can be no longer axially than a standard cap not provided with child-resistant means and which cap also can be utilized to close a container not provided with a cooperating neck finish when the child-resistant feature is not required.

And a still further object of the instant invention is to provide child-resistant means for a cap and container so designed as to require a minimum of material for fabrication of the cap thus to minimize the cost.

BRIEF DESCRIPTION OF THE DRAWINGS

FIG. 1 is a fragmentary view in perspective of child-resistant looking means embodying the invention shown in place on a container;

FIG. 2 is an enlarged, top plan view of the container and cap illustrated in FIG. 1, showing the cap in closed, child-resistant position;

FIG. 3 is a further enlarged, fragmentary, vertical sectional view taken along the line 3—3 of FIG. 1;

FIG. 4 is a view similar to FIG. 2 but showing how the locking means are actuated to disengage the cooperating elements and allow the cap to be removed by unscrewing it;

FIG. 5 is a view similar to FIG. 4 but illustrating how the locking means become more effective when it is attempted to unscrew the cap without carrying out the second necessary releasing step;

FIG. 6 is a fragmentary, vertical sectional view taken along the line 6—6 of FIG. 4;

FIG. 7 is a view similar to FIG. 6 but taken along the line 7—7 of FIG. 5;

FIG. 8 is top plan view on a smaller scale illustrating a modified form of child resistant locking means embodying the invention; and FIG. 9 is a view similar to FIG. 8 illustrating yet another modification of locking means embodying the invention.

DESCRIPTION OF PREFERRED EMBODIMENT

The preferred embodiment of the invention is illustrated in FIG. 1—7, inclusive. An inverted cup-shaped cap 10 has a disc-like top 11 and an annular skirt 12 depending from the margin of the top 11. The inner surface of the skirt 12 has conventional closure threads 13 which mate with cooperating threads 14 on the outer surface of a neck 15 of a container generally indicated by the reference number 16. A conventional liner 17 is shown in place inside the cap 10 and illustrated as being tightly squeezed against the open lip of the tubular container neck 15.

Although not comprising a part of the instant invention, and as best can be seen in FIGS. 3, 6, and 7, the illustrated cap 10 and container neck 15 have retaining means which are the subject matter of my U.S. Pat. Nos. 3,971,487 and 3,986,626. These means are inwardly directed camming elements 18 which cooperate with an outwardly flared rib 19 in order to hold the cap 10 down with the liner 17 tightly compressed even though the cap 10 may be so positioned that the two sets of threads 13 and 14 are not bearing upon each other, i.e. as results from manufacturing tolerances of these parts or as may result after repeated removals and replacements of the cap 10 which tends to give the liner 17 a "set" requiring that the cap 10 be screwed further down on the neck 15 in order to make a tight closure. In the latter case, the cooperating elements 18 and rib 19 hold the cap down in sealed position even if it is partly unscrewed.

The child-resistant locking means embodying the invention consists of cooperating elements integrally carried by the cap 10 and on the container 16 or its neck 15. In the preferred embodiment the container 16 has two outwardly extending stops 20 located at the base of its neck 15. Each of stops 20 has an approach face 21 which extends outwardly relative to the outer surface of the neck 15 and an abutment face 22 on the clockwise side of the stop 20. The abutment face 22 returns inwardly from the outer end of the approach face 21 very abruptly. Indeed, in the specific embodiment illustrated in FIGS. 1–7, the abutment face 22 returns inwardly at an angle less than 90° to a tangent at the surface of the neck 15 at the point of intersection of the face 22 therewith.

The cooperating means on the cap 10 are a pair of cap lugs 23 which depend from a resilient member 24. In this embodiment the member 24 is a ring which defines an orbit around the cap 10 i.e. it is either circular or oval in shape, and is illustrated as being oval in plan view. The ring 24 is integrally connected to the outer side of the cap skirt 12 by a pair of webs or struts 25. In the normal relaxed condition of the resilient member 24, the struts 25 extend generally radially relative to the cap 10 and the cap lugs 23 lie in a circumferential path which is obstructed by the container stops 20, being engaged with the stops 20 (as shown in FIGS. 1–3, inclusive) to prevent rotation of the cap 10 and thus removal from the container 16 unless the cap lugs 23 are displaced outwardly relative to the stops 20.

When it is desired to remove the cap 10 from the container 16, the person wishing to gain access to its contents squeezes the ring 24 along the diameter indicated by the arrows in FIG. 4 until the ring 24 engages the outer surfaces of the cap skirt 12. By thus distorting the ring 24 inwardly along one diameter, the ring 24 is forced outwardly along a diameter at roughly 90° therefrom moving the cap lugs 23 out of alignment with the container stops 20. While maintaining the squeezing action against the ring 24 the user can then turn that ring 24 and the cap 10 to which it is integrally connected, unscrewing the cap 10 from the container neck 15 for removal. When the ring is distorted as shown in FIG. 4, the struts 25 are slightly twisted as illustrated.

When it is desired to replace the cap 10 on the container 16, the user simply turns the cap onto the container neck 15 engaging the cooperating threads 13 and 14 and turning the cap 10 downwardly until the cap lugs 23 engage the approach faces 21 of the stops 20 which flexes the ring 24 outwardly. As the user continues to rotate the cap the lugs 23 pass the stops 20 and, by reason of the resiliency of the ring 24, the lugs 23 snap inwardly behind the abutment faces 22. The user then continues to rotate the cap 10 slightly if necessary until the camming elements 18 snap inwardly beneath the rib 19 squeezing the cap 10 and its liner 17 tightly against the open end of the container neck 15.

It will be appreciated that when the manufacturing tolerances of the threads 13 and 14 are such that they cumulate, or after the cap 10 has been removed and replaced a number of times and the liner 17 has taken what is called "set", the cap 10 may be turned a little further onto the neck 15 but in any event, the cooperative action of the elements 18 and rib 19 will continue to be effective as taught in my earlier patents mentioned above. Of course, whether or not a cap embodying the present invention is provided with these elements 18 and 19 the child-resistant locking means of the present invention would be effective.

It also will be appreciated that even if the cap 10 is turned on to the container neck 15 to a degree such that the cap lugs 23 depart in a clockwise direction from the container stops 20, the child-resistant means remain effective because when a child attempts to rotate the cap 10 in a counterclockwise direction, the cap lugs 23 will engage the abutment faces 22 of the container stops 20 preventing removal of the cap.

Indeed, if someone endeavors to remove the cap 10 simply by rotating it without carrying out the unexpected squeezing operation illustrated in FIG. 4, the condition illustrated in FIG. 5 results. It will be seen in FIG. 5 that the ring 24 has not been squeezed along the line indicated by the arrows in FIG. 4 but has merely been rotated slightly from the position shown in FIG. 2. Continued rotational force exerted on the ring 24 causes the cap lugs 23 to be cammed inwardly by the engagement of the lug 23 with the abutment faces 22 and even more tightly secures the cap 10 in child-resistant locked position.

It will be noted in FIGS. 2, 4 and 5 that the flexible struts 25 are positioned approximately 45° circumferentially from the edges of the cap lugs 23 which engage the abutment faces 22 to result in locking the cap 10 against removal. The positioning at approximately 45° is preferred because, when the ring 24 is squeezed as illustrated in FIG. 4, this results in the greatest outward displacement of the cap lugs 23 so that they clear the container stops 20 enabling the cap to be removed. However, it also has been found that if the strut or struts is or are positioned at a distance of from about 30° to 60° circumferentially away from the cap lugs 23 outward displacement of the cap lugs 23 is adequate for clearance when desired. If the circumferential spacing of the cap lugs relative to the struts is less than about 30° or more than about 60° adequate displacement outwardly of the cap lugs relative to the line of engagement with the container stops is much less easily effected.

ALTERNATIVE EMBODIMENTS

Although the circumferential arrangement of the orbit describing flexible member 24, i.e., a ring, as illustrated in FIG. 1–7, inclusive, is preferred, the utilization of a completely circular or oval resilient member and two diametically opposed container stops 20 and cap lugs 23 is not necessary in order to carry out the teachings of the instant invention.

For example, in FIG. 8, there is shown a simplified construction in which a resilient member 24*a* extends around and is spaced from the skirt of a cap 10*a*. In this embodiment the integral struts constitute end portions 25*a* of the semi-ring 24*a*. The container has but one container stop 20*a* and the cap has only one cap lug 23*a*.

In common with the embodiment of FIGS. 1–7, however, the cap lug 23*a* is displaced outwardly relative to its engagement with the container stop 20*a* by squeezing opposite sides along the line of the arrows in FIG. 8, the user's finger or thumb being engaged with the outer surface of the skirt of the cap 10*a* and the thumb or finger, respectively, being engaged with the resilient member 24*a* to squeeze it inwardly, as shown in broken lines in FIG. 8, thus to displace the cap lug 23*a* outwardly as indicated.

A second alternative embodiment is illustrated in FIG. 9. In this instance, a resilient member 24*b* is shown as being a complete circle and approximately 180° of its extent is integrally connected to the skirt of a cap 10*b* by a number of struts 25*b* all lying on one side of the cap 10*b*. Approximately 180° of the resilient member 24*b* is free of connection to the skirt of the cap 10*b* (as the imbodiment of FIG. 8) and carrys a depending cap lug 23*b*. The container has a single container stop 20*b*.

As can be seen in FIG. 9, when the user squeezes opposing sides of the ring-like resilient member 24*b* as indicated by the arrows in FIG. 9, the "free" half is moved inwardly and the cap lug 23*b* displaced outwardly to clear the container stop 20*b*.

Having described my invention, I claim:

1. Child-resistant locking means for (1) a container which has a body and a tubular neck and (2) a cup-shaped cap which has a circular top and an annular skirt, said container neck and said cap skirt having twist-action, co-operating retaining means, said locking means consisting of:

(a) at least one outwardly extending stop on said container at the base of said neck, said stop having an approach face which slants outwardly relative to the outer surface of said neck and an abutment face on the clockwise side of said stop which extends abruptly inwardly from the outer side of said stop toward said neck, (b) a curved resilient member that extends around the exterior of the base of said cap skirt and that is spaced outwardly from and connected to said cap skirt, and (c) a cap lug on said member that is engageable with said container stop, (d) said member including a pair of outwardly extending strut-like parts connecting said member to said cap skirt, one of said parts being located at a point circumferentially spaced from said cap lug about 30°–60°.

2. Child-resistant locking means according to claim 1 in which the abutment face of the container stop lies in a vertical plane which intersects the exterior surface of the neck at an angle of less than 90° to a tangent to said surface at the line of intersection.

3. Child-resistant locking means according to claim 1 in which one of said struts is located at a point circumferentially spaced from the cap lug in a clockwise direction.

4. Child-resistant locking means according to claim 1 in which the twist-action retaining means are interengaged threads on the container neck and the cap skirt.

5. Child-resistant locking means according to claim 1 in which the curved resilient member has an arcuate extent less than 360°.

6. Child-resistant locking means according to claim 1 in which the resilient member is a ring that defines an orbit around the base of the cap skirt.

7. Child-resistant locking means according to claim 6 in which there are two container stops that are diametrically opposed and there are two cap lugs which are engageable therewith.

8. Child-resistant locking means according to claim 6 in which the struts are located at points spaced about 45° from the cap lugs.

9. Child-resistant locking means according to claim 6 in which the cap ring normally is an oval in plan view.

10. Child-resistant locking means according to claim 9 in which there are two opposed cap lugs located at the lessor diameter of the oval.

* * * * *